US007454308B1

(12) United States Patent
Carroll

(10) Patent No.: US 7,454,308 B1
(45) Date of Patent: Nov. 18, 2008

(54) SYSTEM FOR DETECTION OF WATERLOGGING IN STEAM HEATING COILS

(76) Inventor: Steven Wayne Carroll, P.O. Box 322, Washougal, WA (US) 98671

( * ) Notice: Subject to any disclaimer, the term of this patent is extended or adjusted under 35 U.S.C. 154(b) by 0 days.

(21) Appl. No.: 11/800,880

(22) Filed: May 8, 2007

Related U.S. Application Data

(60) Provisional application No. 60/798,794, filed on May 9, 2006.

(51) Int. Cl.
*H05B 1/02* (2006.01)

(52) U.S. Cl. ..... 702/130; 236/44 R; 219/491; 219/497; 219/494; 219/501; 392/324; 392/386; 392/387; 15/320

(58) Field of Classification Search ..... 702/130; 219/627, 491, 494, 497, 501, 440–442, 505, 219/506, 509; 392/399, 491, 465, 471, 485, 392/449, 324, 386, 387; 236/44 R; 237/67, 237/68; 15/320
See application file for complete search history.

(56) References Cited

U.S. PATENT DOCUMENTS 3,572,588 A * 3/1971 Hamilton, Jr. ..... 237/9 R
3,818,699 A * 6/1974 Pritchard ..... 60/665
4,079,887 A * 3/1978 Paul ..... 237/9 R
4,242,568 A * 12/1980 Wunderlin et al. ..... 392/397
4,303,816 A * 12/1981 Goessler et al. ..... 219/627
4,381,438 A * 4/1983 Goessler et al. ..... 219/627
4,862,526 A * 9/1989 Berger ..... 4/536
4,930,454 A * 6/1990 Latty et al. ..... 122/4 D
5,616,265 A * 4/1997 Altman ..... 219/497
6,367,261 B1 * 4/2002 Marshall et al. ..... 60/670
6,393,212 B1 * 5/2002 Hutchinson ..... 392/491
6,647,204 B1 * 11/2003 Hutchinson ..... 392/491
6,647,931 B1 * 11/2003 Morgandi et al. ..... 122/13.3
6,786,182 B2 * 9/2004 Morgandi et al. ..... 122/4 A
2004/0040185 A1 * 3/2004 Morgandi et al. ..... 38/77.7
2008/0032347 A1 * 2/2008 Sarofim et al. ..... 435/91.2

FOREIGN PATENT DOCUMENTS

JP 2005137381 A * 6/2005

* cited by examiner

*Primary Examiner*—Carol S Tsai
(74) *Attorney, Agent, or Firm*—Rylander & Associates; Kurt M. Rylander; Mark E. Beatty

(57) ABSTRACT

A system is disclosed for detecting the occurrence and extent of waterlogging in steam heating coils which consists of a series of two or more sensors disposed to measure temperature at strategic locations on the heating coils of a steam heat coil panel, a recording device which logs and stores the temperature measurement data at pre-defined incremental intervals over a significant length of the steam heating cycle, and a method for displaying and interpreting the data to accurately identify the existence and extent of waterlogging within the steam heating system. The temperature sensors preferably are attached to the outside wall of the steam heating coils and transmit data to an electronic recording device. In a preferred embodiment the data is displayed as a series of line graphs which can be analyzed by the use of described techniques to identify the occurrence and location of waterlogging within a steam heating coil.

4 Claims, 9 Drawing Sheets

SYSTEM FOR DETECTION OF WATERLOGGING IN STEAM HEATING COILS

CROSS REFERENCE TO RELATED APPLICATIONS

This application is based on provisional application Ser. No. U.S. 60/798,794, filed on May 9, 2006.

BACKGROUND OF THE INVENTION

This invention relates generally to the field of steam heat kiln systems and more specifically to the method and apparatus for detection of waterlogging in steam heating coils.

Steam heat coil systems are used in lumber drying operations in part due to the ability of steam to release latent heat efficiently and relatively uniformly across an array of horizontal fin pipe, known as coils, which are spaced apart in a parallel pattern and connected by header pipes. One section of coils connected by a header pipe on either side is herein referred to as a steam heating coil panel.

Steam is pressured through this coil arrangement in order to provide uniform heat distribution across the coil grid and consequently, to impart a relatively uniform heat output, both vertically and horizontally, to the lumber being dried. If the heat released from the steam heating coil panel is not relatively uniform and varies by more than a few degrees, either vertically or horizontally across the plane of the coil panel, the lumber will dry significantly less uniformly, resulting in a higher percentage of damaged wood products.

Condensed steam, called condensate, is typically removed from the steam heating coils via a steam trap and returned to a boiler for conversion back to steam. When condensate is not effectively removed from steam heating coils and is allowed to build up, it creates a condition called waterlogging. Condensation build-up resulting in waterlogging can be caused by a variety of reasons including back pressure on the steam trap at the end of the coil grid, inadequately sized condensate piping, undersized and/or plugged steam traps, or insufficient steam pressure.

Waterlogging is known to cause disparities in heat distribution of the kiln by preventing an adequate amount of steam from releasing latent heat in the area of the pipes experiencing the condensate build-up. In addition, higher energy costs are often incurred when waterlogging is present near the system's resistance temperature detector (RTD) because the system toggles an increase of steam temperature to the kiln coils to compensate for the decrease in temperature at the RTD due to waterlogging at that point.

Due in part to the harsh environment inherent in this type of operation and lengthy operational cycle time, an effective method of detecting the occurrence of condensate build-up in the steam heating coils of a closed system throughout a significant portion of the operational cycle of a kiln has not been developed before. This has resulted in many kiln operations producing a higher percentage of damaged product and often at an increased cost in energy. In addition, condensate build up has a corrosive effect on the coil pipes resulting in permanent damage, increased chemical treatment costs, and premature aging of the system. Detecting waterlogging in kiln coils is often necessary before corrective measures can be put in place and further, any corrective measures cannot be determined to be adequate without an effective means of subsequent evaluation.

While it is known in the industry that build-up of condensate in a steam heating system reduces efficiency and increases operating costs, common practices to identify the occurrence of condensate build-up and waterlogging generally focus on steam traps in the system including visual inspections of steam trap discharge, temperature and pressure measurements taken on steam traps, and acoustic signals from steam traps.

Both U.S. Patent Application Publication No. U.S. 2006/0122808 A1 and U.S. Patent Application Publication No. U.S. 2007/0073495 A1 disclose methods for analyzing steam trap data by the placement of monitoring devices on or near a steam trap and the subsequent capture and analysis of the data to indicate steam trap operating conditions.

U.S. Patent Application Publication No. U.S. 2001/0007093 A1 proposes an evaluating system that uses steam trap surface temperatures along with measurements of the level of vibrations at the steam trap to determine the extent of steam trap leakage.

While measurements of steam trap conditions can be analyzed for reasonable indications of steam leakage through a steam trap or indicate the potential for condensate build-up in the system, steam trap analysis alone does not provide adequate indications of the extent of condensate build-up within a system, the impact of waterlogging on the efficiency of the system, or the corrosive effects of waterlogging within the specific coils where it is taking place. These methods only provide data specific to the location of the steam trap and the efficiency of the steam trap being measured and do not address the efficiency of the heat distribution across the entire system, of which the steam trap is only one component.

In a steam heat drying kiln operation such as those used for drying lumber, it is important to understand the extent to which condensate build-up and waterlogging may be occurring across the entire system of heating coils and throughout the length of the drying cycle which can operate continuously for more than 30 hours. Without knowledge of the degree of waterlogging taking place, and at what point in time it is likely to occur within a system, it is difficult to gauge the efficiency of the system and consequently, the economic impact of the performance of the system or make an economic evaluation of the value of improving it. Consequently, evaluation of steam trap efficiency alone will not provide the needed indication of the system performance as a whole or the effectiveness of attempted corrections to the system, especially if the root cause of the waterlogging condition is due to something other than the steam trap operation.

Consequently, a need exists to be able to identify condensate build-up at varying vertical distances of the heating coils throughout the length of the drying cycle. U.S. Patent Application Publication No. U.S. 2006/0070438 A1 proposes a method of determining a density-compensated liquid level in a vessel containing a mixture of liquid and vapors by the use of pressure and temperature sensors located on or near the containment vessel in combination with calculations utilizing the specific gravities of the contained liquids. U.S. Patent Application Publication No. U.S. 2004/0181349 A1 describes a software-based water level monitoring and control system for use with conventional steam boilers through the use of level sensors in combination with a computer monitoring system. Both of these processes describe methods of identifying liquid levels within a specific container, however and do not address the challenges of measuring condensate build-up within heating coils containing steam moving through them continuously. Further, both processes require the use of measurement devices that must be inserted into the body of the vessel, which requires extensive modifications for installation in a system, nor do they provide for storing, displaying, and analysis of measurements of conditions over the length of a typical operational cycle in order to identify the degree to which waterlogging may be occurring.

There is therefore a need in the art for a process of easily identifying condensate build-up across steam heating coils over the length of an operational cycle and capturing, storing, trending, and displaying measurements of uniformity of heat distribution across the heating coils for evaluating system efficiency. These needs and others which will become apparent to one skilled in the art are provided by the present invention, which is summarized and described in detail below.

BRIEF SUMMARY OF THE INVENTION

The primary object of the invention is to provide a system for detecting the occurrence and extent of waterlogging in steam heating coils consisting of a series of two or more sensors disposed to measure temperature at strategic locations on the heating coils of a steam heat coil panel, a recording device which logs and stores the temperature measurement data at incremental intervals over a significant length of the steam heating cycle, and a method for displaying and interpreting the data to accurately identify the existence and extent of waterlogging within the steam heating system.

The temperature sensors preferably are attached to the outside wall of the steam heating coils and transmit data to an electronic recording device. In a preferred embodiment the data is displayed as a series of line graphs which can be analyzed by the use of described techniques to identify the occurrence and location of waterlogging within a steam heating coil.

Further objects and advantages of this invention include the ability to identify inefficient and inconsistent heat distribution within a steam heating coil system, the ability to identify causes of water related pipe damage in steam heat kiln systems, the extent to which waterlogging may be occurring within said system, and the ability to accurately measure the effects of system modifications taken to reduce or eliminate waterlogging in a system.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
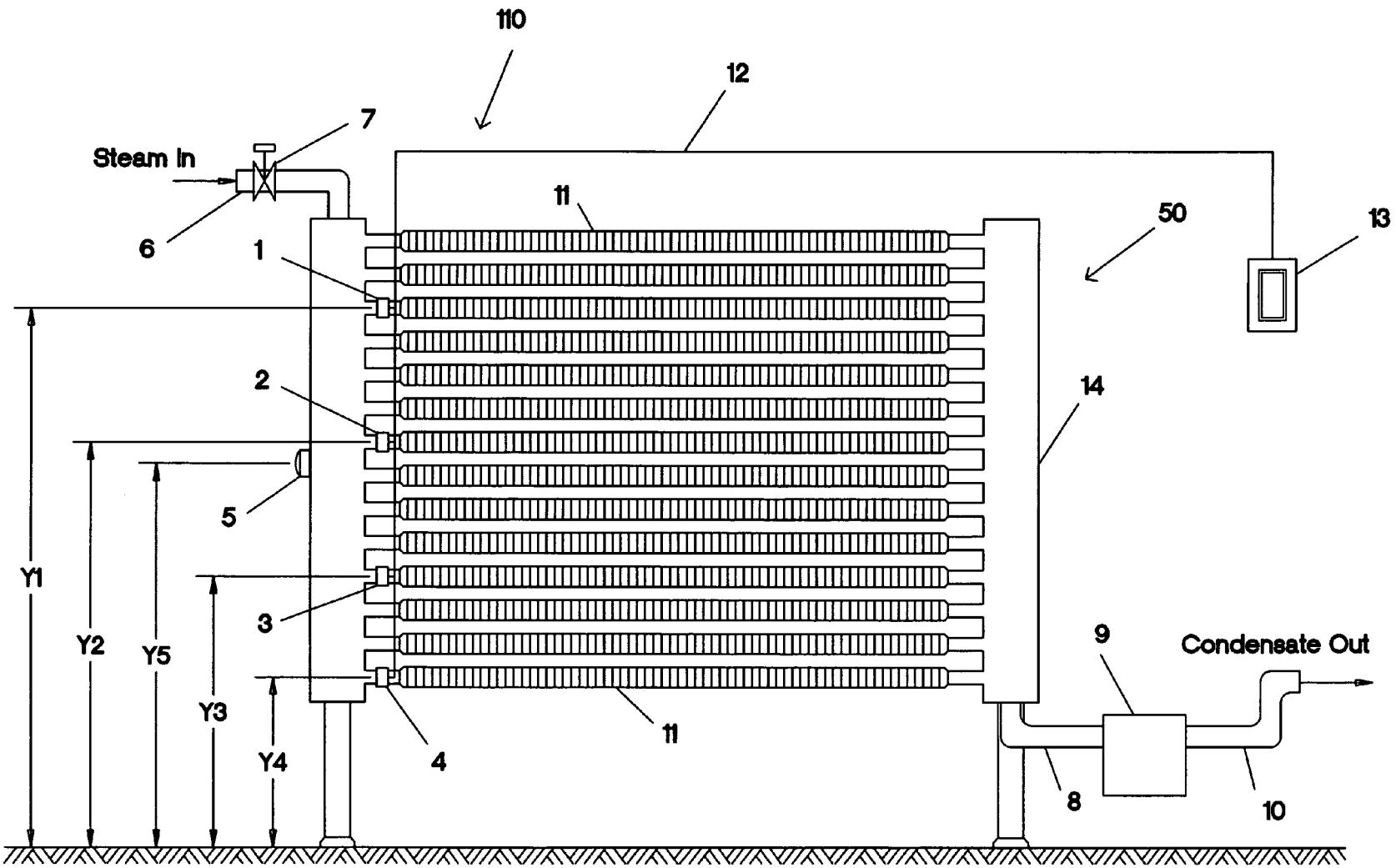
FIG. 1 is a side elevation view of a typical steam heating coil panel 50. In an exemplary embodiment of the invention, attached to the steam heating coil panel 50 are thermocouple sensors 1-4, which together with wire transmission lines 12 and data recorder 13, make up temperature recording component 110.

Referring to the drawings, wherein the same reference numbers refer to the same elements of the invention, there is illustrated in FIG. 1 a typical steam heating coil panel 50 which is comprised of a steam inlet pipe 6, steam inlet valve 7, steam coils 11 (multiple), vertical risers 14 (2), steam outlet pipe 8, steam trap 9, steam trap outlet pipe 10, and resistance temperature detector 5 mounted at a vertical distance Y5 from ground level, which is an arrangement common in the industry. This illustration is to aid in the explanation of the invention in typical steam heat applications and not to restrict the invention to any one specific steam heating system arrangement. The invention will also apply to variations of this system configuration as well as other common steam heat system configurations not specifically illustrated herein.

System Temperature Measurements

FIG. 1 shows an exemplary embodiment of a component of the invention in which thermocouple sensors 1-4 are attached at varying vertical distances Y1-Y4 respectively, to steam coils 11 (4) of steam heating coil panel 50. In this embodiment, thermocouple sensors 1-4 are connected together with wire transmission lines 12 and further, to data recorder 13, all of which make up temperature recording component 110. This example uses four thermocouple sensors but the invention is not restricted to this quantity and may utilize more or fewer sensors without limiting its scope or function. The temperature sensors are placed at varying vertical levels that will provide a good contrast of temperature variations across the face of steam heating coil panel 50. Typically one temperature sensor would be placed near any resistance temperature detector 5 provided with the system but this is not required for acceptable implementation of the process.

FIG. 1 illustrates a typical arrangement of a preferred embodiment of the invention for temperature sensors 1-4 on steam coils 11 (4). In this configuration, thermocouple sensors 1-4 are mounted on the top of steam coils 11 (4) at the inlet (steam in) side. In this way, normal temperature depressions that might occur from condensate runoff along the bottom of the pipe, and that could skew or mask symptoms of waterlogging, can be eliminated. Thermocouple sensor 2 is mounted on steam coil 11 near resistant temperature detector 5.

The invention is not limited to the use of the above-described temperature measuring thermocouple sensors. Other products known in the industry may also be used that continuously measure temperature including temperature sensors that can be placed inside the wall of steam heating coils 11 (multiple) to measure steam temperature directly as well as measurement devices that do not require attachment to the coil walls such as infrared temperature measuring devices which may measure temperature at specified points on steam heating coil panel 50 from a remote location.

In the present embodiment, a Sper Scientific, Model #800024 4-channel Datalogging Thermometer is used as temperature recording component 110. The product includes a number of thermocouple probes which can function as thermocouple sensors 1-4 in the present embodiment although other thermocouple probes from competitive manufacturers and datalogging devices may also be employed.

Data Recording

In the present embodiment, the above referenced Sper Scientific, Model #800024 4-channel Datalogging Thermometer product provides a recording mechanism which can be used as data recorder 13 as shown in FIG. 1, for capturing the temperature readings at the thermocouple sensor locations at continuous intervals. However, other recording devices may also be used including similar competitive products or a computer or similar microprocessor device with data storage capability known to be available.

Referring again to FIG. 1, transmission of temperature readings from thermocouple sensors 1-4, to data recorder 13 is shown by use of wire transmission line 12. However, other means of transferring the temperature data may also be employed within the scope of the invention including storage of the temperature data in the temperature sensors to be later manually connected to a computer for transfer and aggregation of the data or by means of wireless data transmission methods from temperature sensors 11 (multiple) to data recorder 13 as are known in the art. Further, in another embodiment, it is within the scope of the invention that one of the multiple temperature sensors 11, herein referred to as the master temperature sensor, may also serve as data recorder 13 by means of receipt of data transmitted from the other temperature sensors and storage therein.

In the present embodiment, temperature measurements would be recorded approximately once per minute although longer or shorter measurement intervals could also be used with acceptable results.

Data Output and Interpretation

Figure 7:
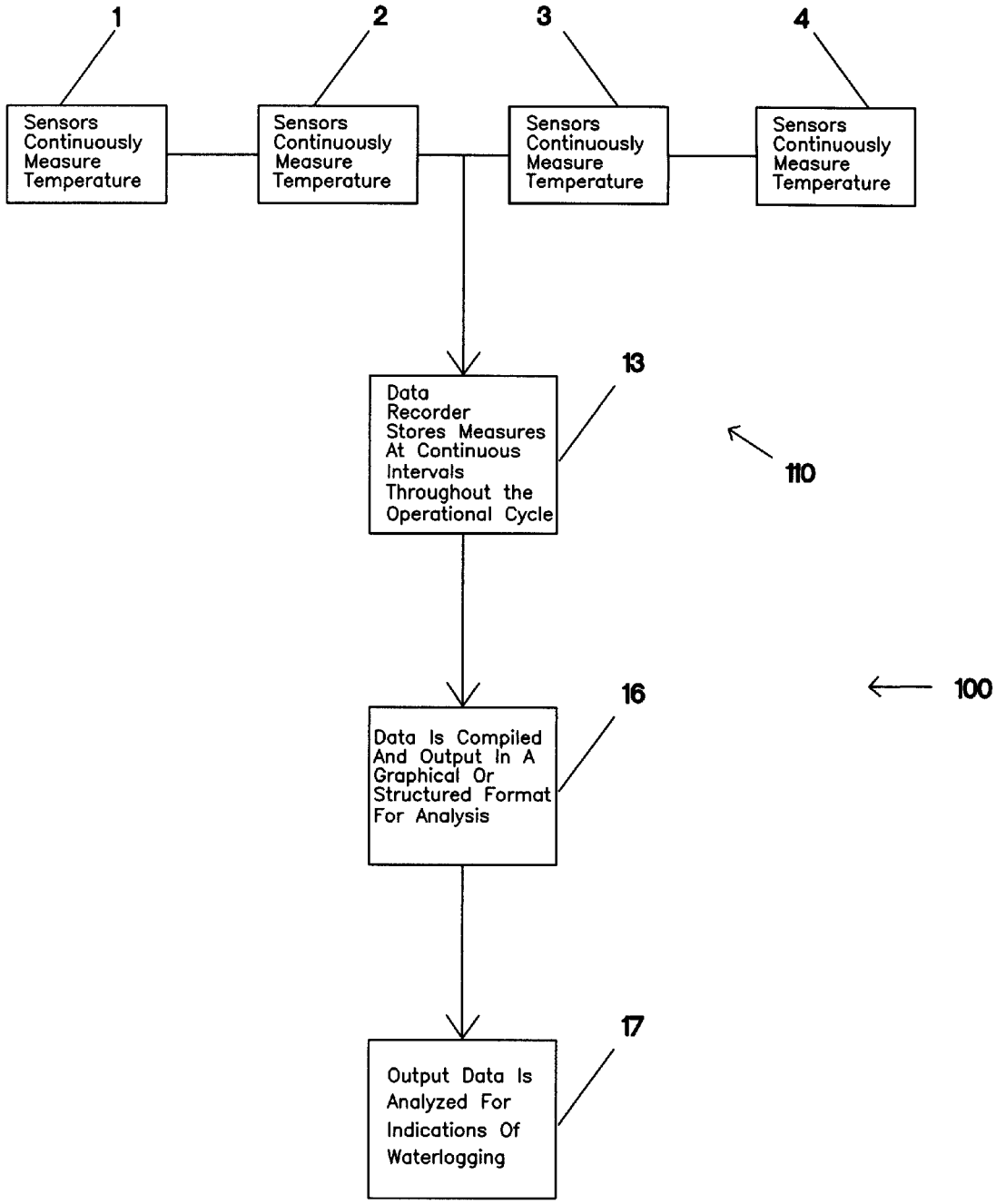
FIG. 7 is a flow chart illustrating the major process steps of the invention.

FIG. 7 illustrates the process steps beginning with the flow of data in the present embodiment from the thermocouple sensors 1-4 to data recorder 13 and thereafter to step 16 wherein the data is compiled and output in a graphical or structured format for analysis and further to step 17 wherein the output is analyzed for indications of waterlogging. In a preferred embodiment data recorder 13 is also used to generate the referenced output although it is within the scope of the invention that other means may also be employed including but not limited to transfer of the recorded data in data recorder 13 to a computer for formatting, analysis, and output. Similarly, the software used to produce said output is not restricted to one program but can be achieved through the use of a number of analysis tools available including common spreadsheet programs like Microsoft Excel.

Figure 8:
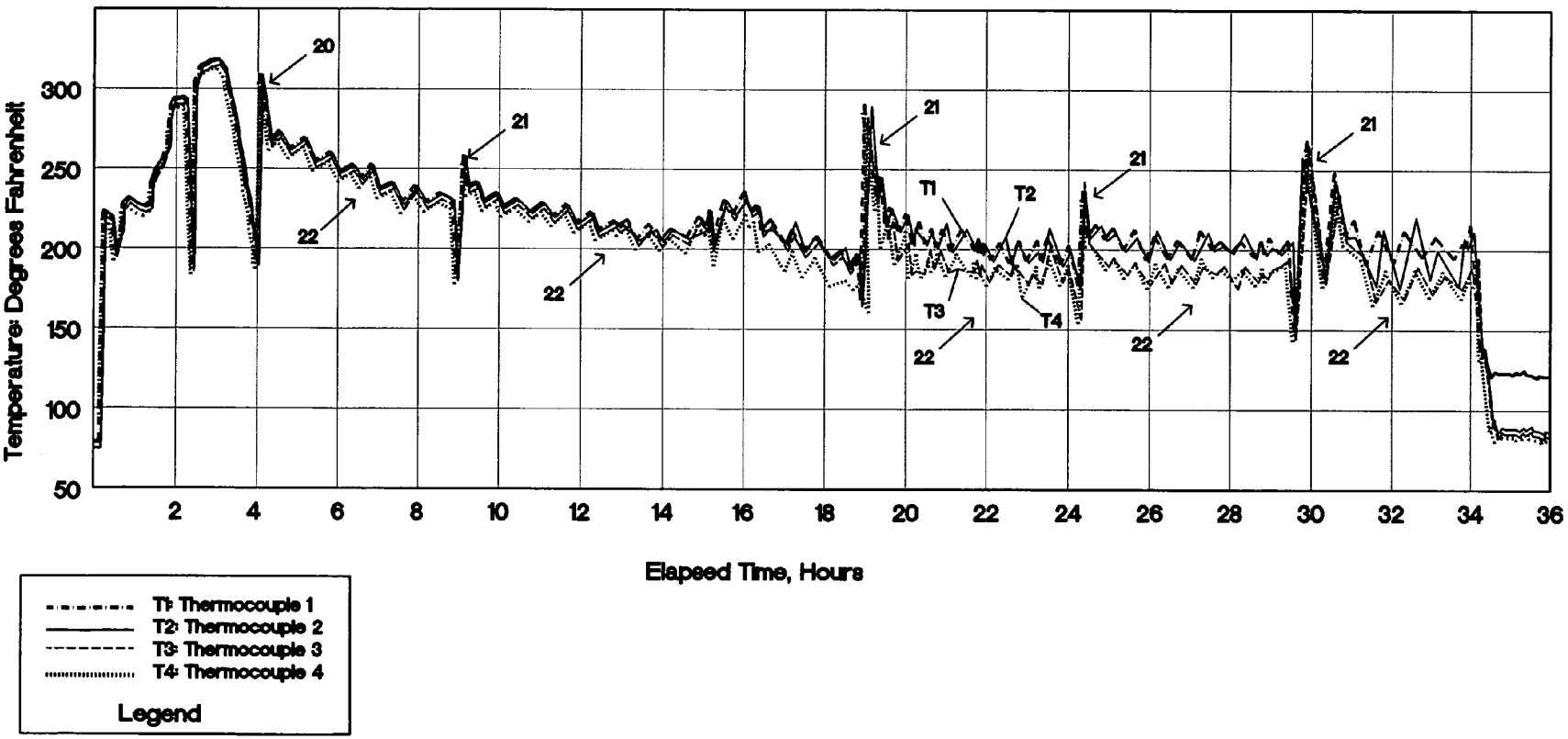
FIG. 8 is a graph illustrating a typical wood drying operational cycle with lines T1-T4 representing temperatures recorded by exemplary thermocouple sensors 1-4 charted over the length in time of a typical operational drying cycle.

FIG. 8 illustrates a line graph used in the preferred embodiment to display the temperatures recorded over the course of a typical operational cycle of a steam heat system where waterlogging eventually occurs and where T1-T4 are graph lines that represent measurements taken from thermocouple sensors 1-4 respectively with the x-axis representing elapsed time in hours and the y-axis representing temperature in degrees Fahrenheit.

The invention is not limited to the use of the specific output format illustrated but may use other known methods of displaying the relationships of the data measurements by the various temperature sensors over time such as bar graphs, scatter charts, pie charts, or other means of comparative analysis commonly known in the art.

Figure 2:
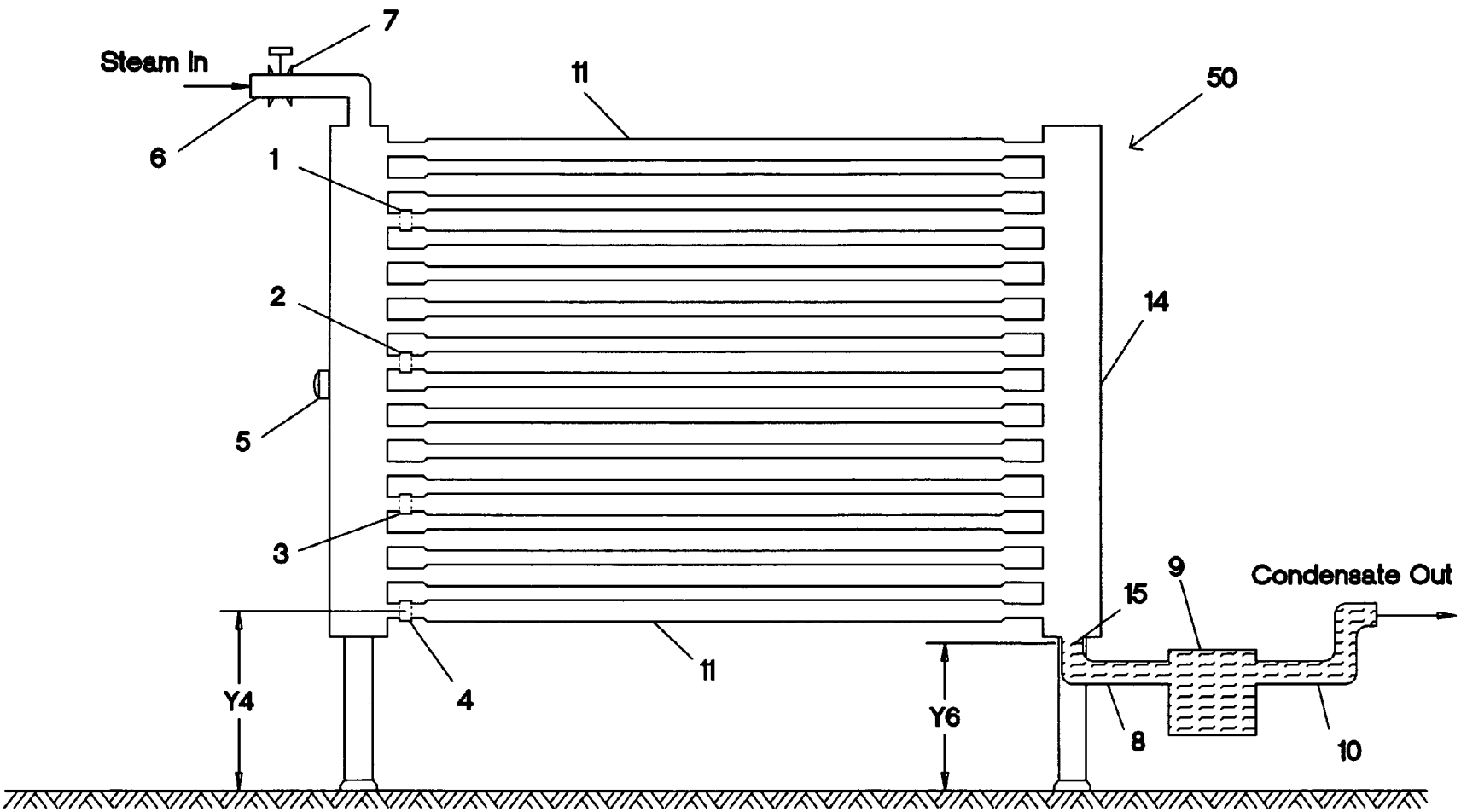
FIG. 2 is a cross sectional view of panel 50 in a normal operating condition with steam water condensate present in steam trap 9 and below any of the exemplary thermocouple sensors 1-4.

It can be seen in this illustration that certain temperature spikes occur as a result of the system increasing steam heat in order to maintain a certain minimal temperature. This increase is triggered by resistant temperature detector 5 shown on FIGS. 1-6 when it detects temperature below a determined level. Referring again to FIG. 8, after the initial start-up temperature cycle 20, which occurs from the start of the cycle up to approximately hour 4, the graph illustrates a gradual cooling cycle 22 over the course of several hours and at all temperature sensors, after which time an additional heating cycle 21 is triggered by resistant temperature detector 5. It can be further seen in this example, the pattern of the graph lines are tightly grouped throughout the heating and cooling cycles from hour 0 to approximately hour 14. In this part of the cycle, the temperature differences experienced by thermocouple sensors 1-4 are minimal. This is considered a normal and adequate operational cycle with no indication of waterlogging. FIG. 2 illustrates a cross-sectional view of steam heating coil panel 50 in a normal and sufficient operating cycle where condensate build-up 15 at level Y6, is restricted to the level of steam trap 9 and is contained within steam trap inlet pipe 8 and steam trap outlet pipe 10.

Figure 3:
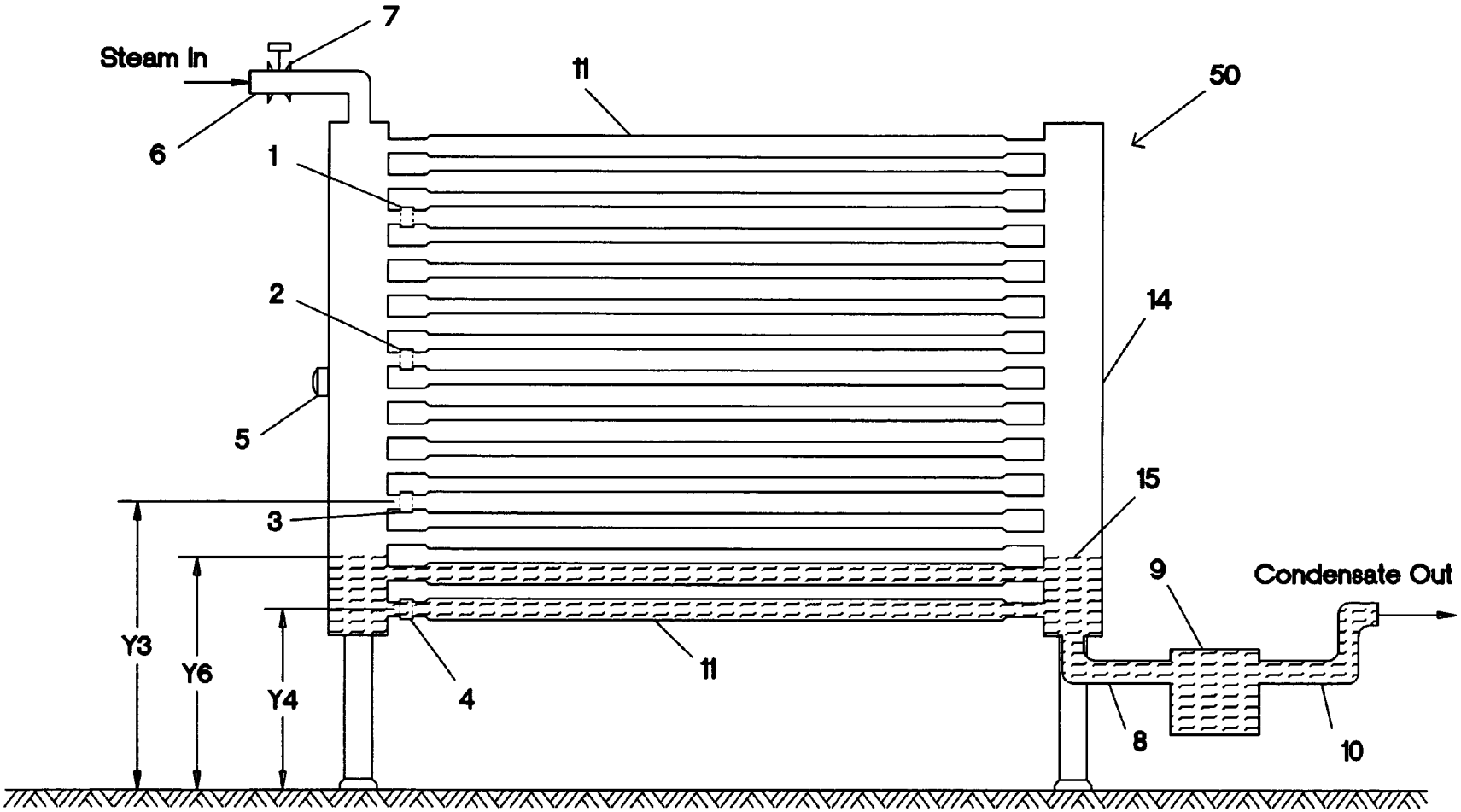
FIG. 3 is a cross sectional view of panel 50 in an impaired operating condition with the presence of steam water condensate above first level exemplary thermocouple sensor 4 and below second level exemplary thermocouple sensor 3.

Referring again to FIG. 8, after hour 14, graph line T4 begins to show a consistent decrease in temperatures recorded by thermocouple 4 compared to graph lines T1-T3 recorded by thermocouples 1-3 respectively. This is further illustrated in FIG. 9 which is that portion of the graph of FIG. 8 beginning at hour 14 and continuing through the end of the operational cycle and is shown enlarged for clarity. This separation is demonstrated by temperature difference D1, which approximates the average temperature difference between graph line T4 and the combination of graph lines T1-T3 during the approximate period of hours 16.5 through 19. This temperature difference is an indication of waterlogging in steam heating coil panel 50 which is illustrated in FIG. 3 where condensate build-up 15 has accumulated to a height Y6 above the height Y4 of thermocouple sensor 4. This accumulated condensate build-up is an example of waterlogging and reduces the ability of the system to efficiently impart heat to the coils where condensate has accumulated.

Figure 4:
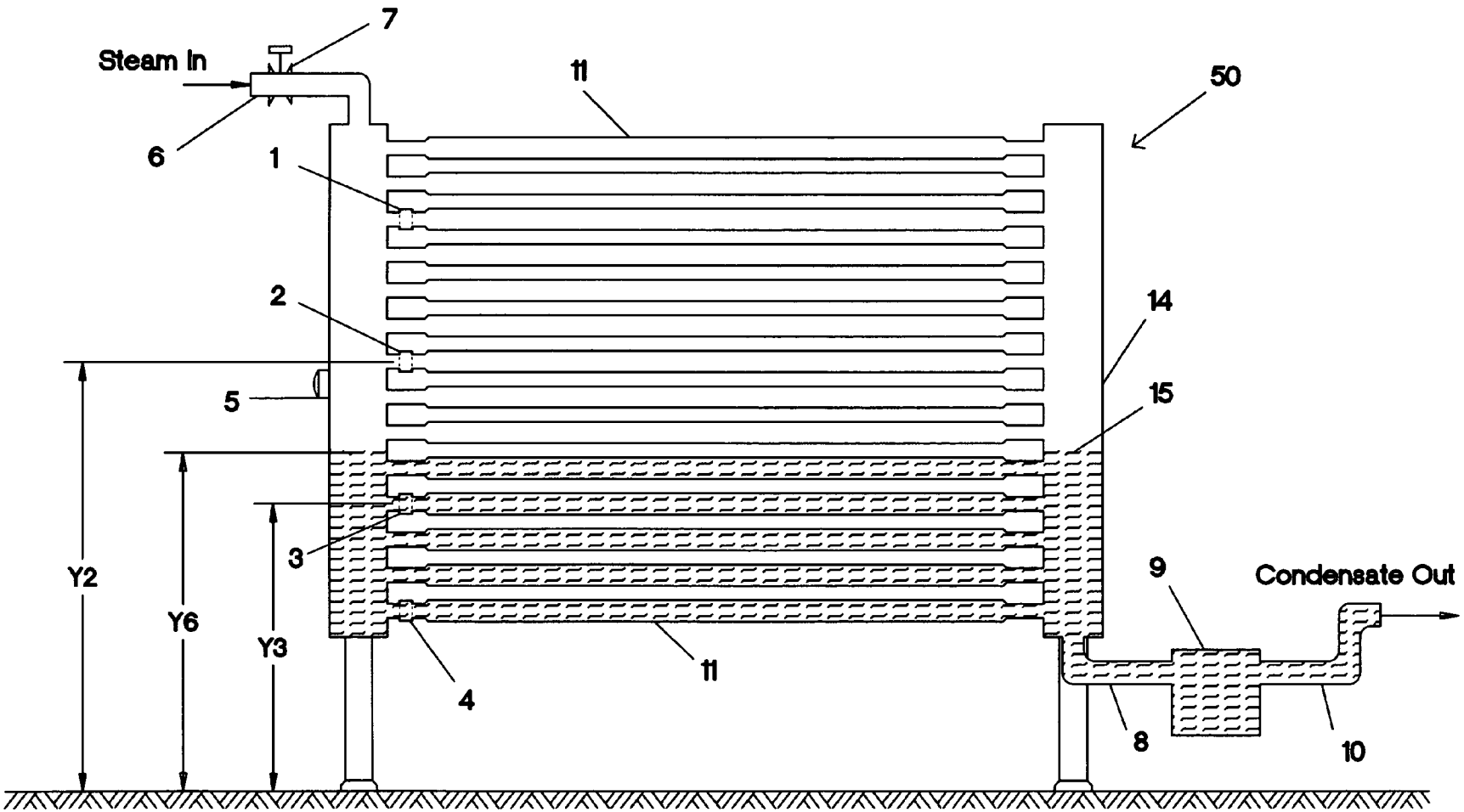
FIG. 4 is a cross sectional view of panel 50 in an impaired operating condition with the presence of steam water condensate above second level exemplary thermocouple sensor 3 and below third level exemplary thermocouple sensor 2.
Figure 9:
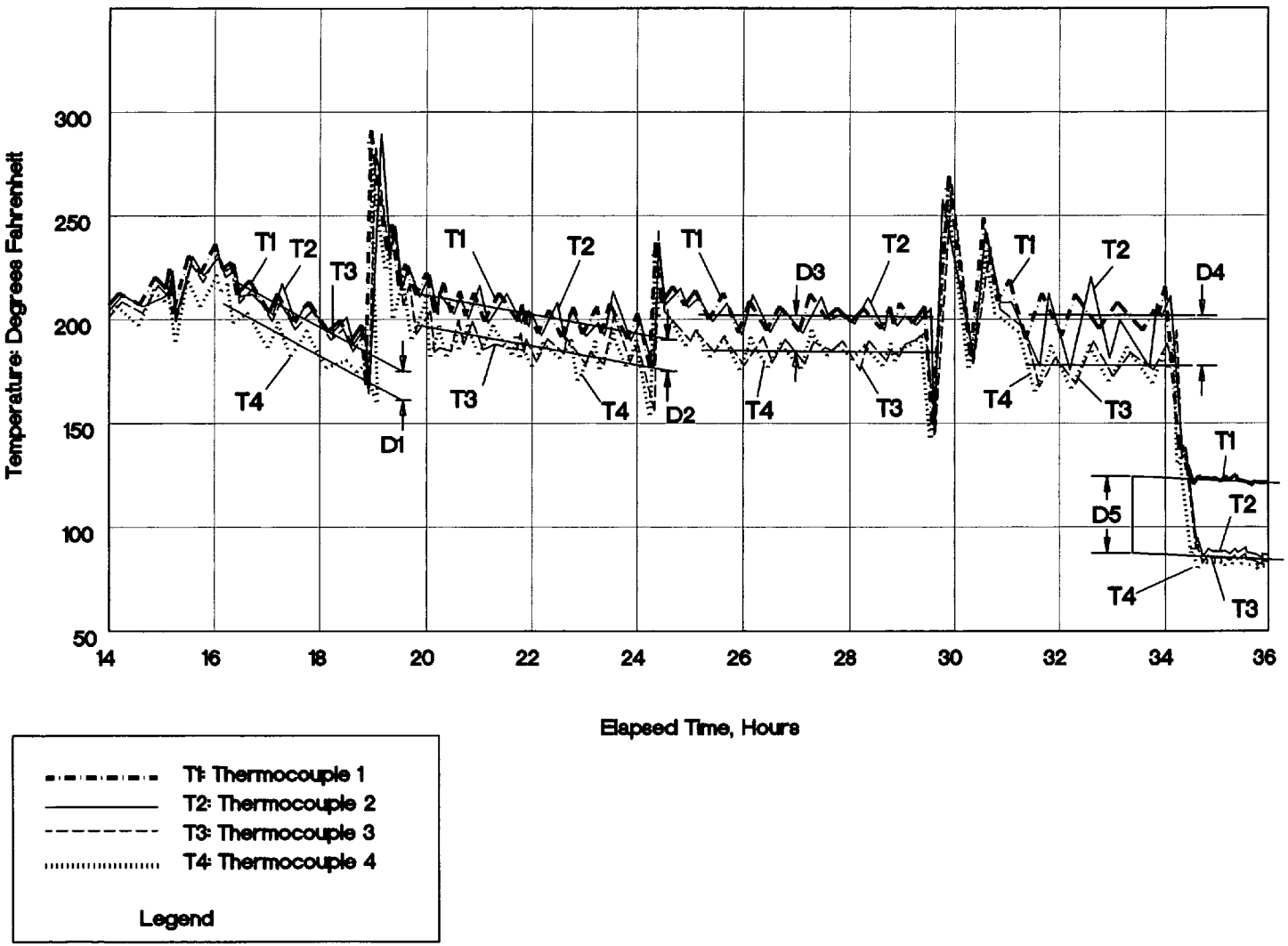
FIG. 9 is a portion of the graph of FIG. 8 illustrating that part of a typical wood drying operational cycle where condensate has occurred to the degree that it is significantly reducing the uniformity of heat distribution across the illustrated steam heating coil panel 50.

Continuing to refer to FIG. 9, temperature difference D2 is shown, which approximates the average temperature difference between graph lines T1 and T2 combined and graph lines T3 and T4 combined during the approximate period of hours 20 through 24. During this period graph line T3 displays a reduction in temperature, similar to that of graph line T4 in the prior period, indicating thermocouple 3 registering consistently lower temperatures than thermocouple sensors 1 and 2 located above it. Temperature difference D2 is an indication of waterlogging in steam heating coil panel 50 at a level above that of thermocouple sensor 3. This condition is illustrated in FIG. 4 where condensate build-up 15 has accumulated to a height Y6 above the height Y3 of thermocouple sensor 3.

Continuing to refer to FIG. 9, temperature difference D3 is shown, which approximates the average temperature difference between graph lines T1 and T2 combined and graph lines T3 and T4 combined during the approximate period of hours 25 through 29. Temperature difference D3 demonstrates a continuing difference between the average temperatures of graph line groups T1 and T2 compared to T3 and T4, similar to that of D2 described above. In addition, temperature difference D3 increases above temperature difference D2 indicating further condensation accumulation between thermocouple sensors 2 and 3 shown in FIG. 4.

Figure 5:
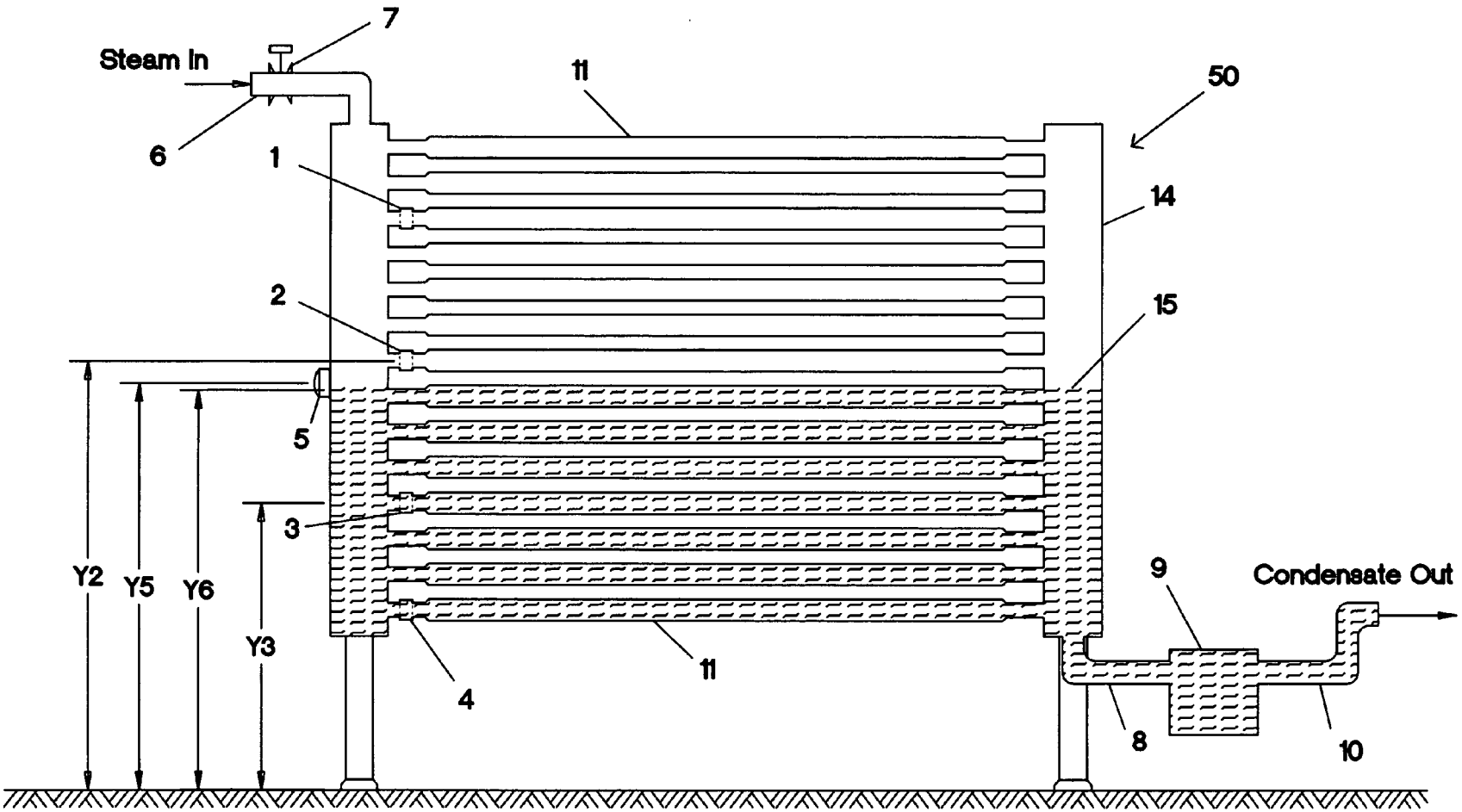
FIG. 5 is a cross sectional view of panel 50 in an impaired operating condition with the presence of steam water condensate above second level exemplary thermocouple sensor 3, below third level exemplary thermocouple sensor 2 and close to resistant temperature detector 5.

Continuing to refer to FIG. 9, temperature difference D4, is shown which approximates the average temperature difference between graph line T1 and graph lines T3 and T4 combined during the approximate period of hours 31.5 through 34. During this period graph line T2 displays a periodic reduction and recovery relative to graph line T1, which indicates a level of waterlogging Y6 above thermocouple 3 and close to level Y5 of resistant temperature detector 5 as is shown in FIG. 5. In operation, as condensate build-up rises to level Y5, resistant temperature detector 5 detects the resulting decrease in temperature and triggers the opening of steam inlet valve 7 to increase steam pressure in coil panel 50. The resulting increase in steam then pushes accumulated condensate 15 below level Y5, thereby raising the temperature in the vicinity of resistant temperature detector 5, which subsequently triggers the closing of steam inlet valve 7. In the graph of FIG. 9, this opening and closing cycle of steam inlet valve 7 continues until approximately hour 34 and is indicated by graph line T2 fluctuating roughly between the average temperature difference of graph line T1 and graph lines T3 and T4 combined, after which the system enters an idling period prior to beginning the next drying cycle.

Figure 6:
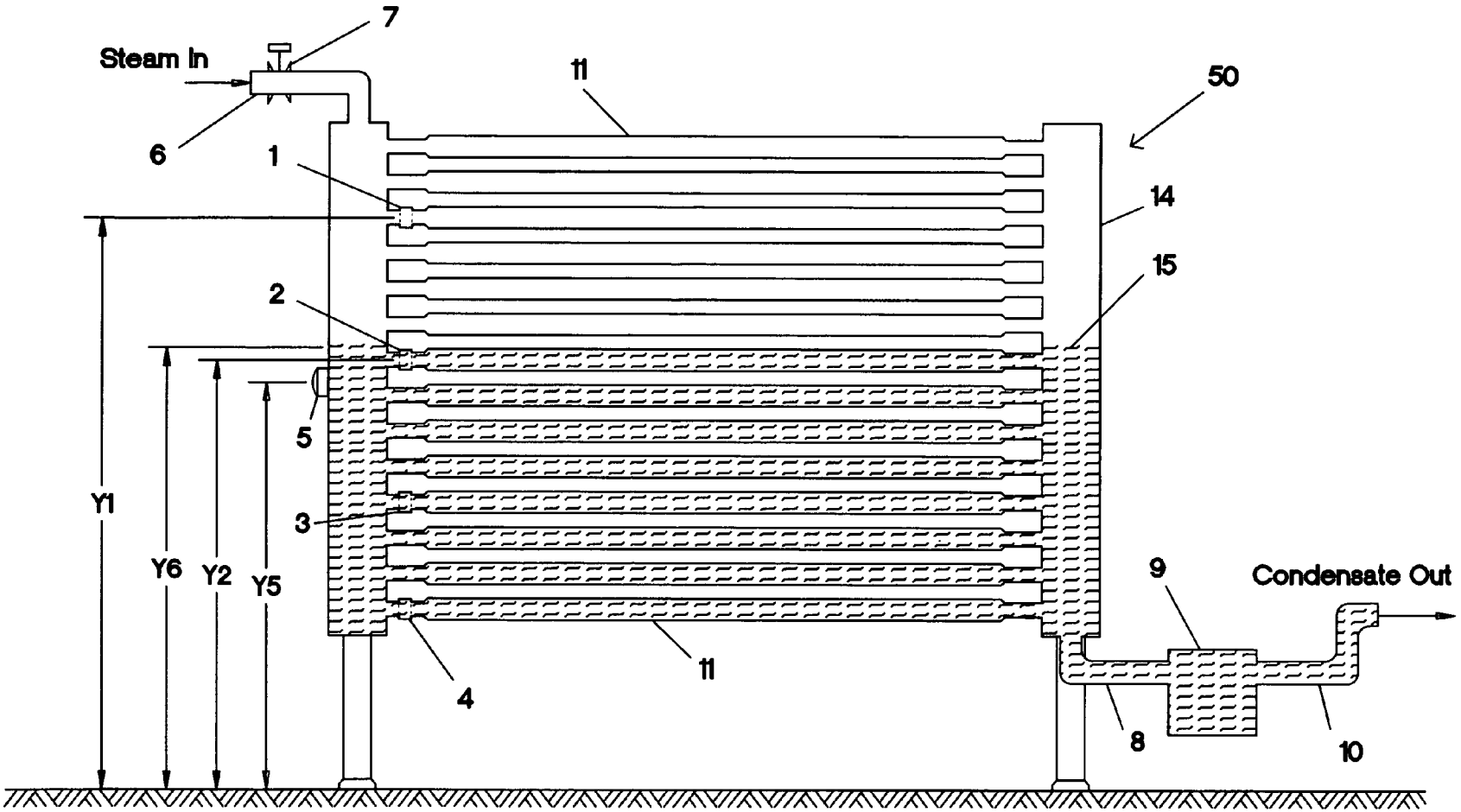
FIG. 6 is a cross sectional view of panel 50 in an impaired operating condition with the presence of steam water condensate above third level exemplary thermocouple sensor 2 and resistance temperature detector 5 and below fourth level exemplary thermocouple sensor 1.

Referring again to FIG. 9, the portion of the graph after hour 34 reflects the system idling period between drying cycles. Temperature difference D5 is shown which approximates the average temperature difference between graph line T1 and combined graph lines T2, T3 and T4 during the approximate period of hours 34.5 through 36. During this period continued condensate build-up is indicated by graph line T2 exhibiting a decrease in temperature measure similar to that of graph lines T3 and T4. This indicates further condensation accumulation at level Y6 above level Y2 of thermocouple sensor 2 but below level Y1 of thermocouple sensor 1 which is illustrated in FIG. 6.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A system for detecting waterlogging in a steam coil heating system, wherein said steam heating coil system is comprised of a steam inlet header, a steam-condensate outlet header, and a series of parallel steam coils, each of said steam coils in fluid communication with said inlet header and said outlet header, said waterlogging detection system comprising:

a plurality of temperature sensors, each of said temperature sensors located to measure a selected heating coil;

temperature data recording means in communication with said plurality of temperature sensors for receiving temperature data from said temperature sensors and recording said temperature data at selected time intervals for display and evaluation;

display means in communication with said temperature data recording means for displaying said temperature data for each of said plurality of temperature sensors;

comparison means for determining the difference in the average temperatures recorded by said temperature data recording means between each of said plurality of temperature sensors; and, indication means for indicating a waterlogged condition, wherein a waterlogged condition is indicated when the average temperature of one or more of said plurality of temperature sensors closest in proximity to said discharge header remains significantly lower over a selected time interval than the average temperature of one or more of said plurality of temperature sensors more distal from said discharge header.

2. A system for detecting waterlogging in a steam heating coil system as in claim 1, wherein a waterlogged condition is indicated when the average temperature of one or more of said plurality of temperature sensors closest in proximity to said discharge header remains at least 5° F. (9° C.) lower over a selected time interval than the average temperature of one or more of said plurality of temperature sensors more distal from said discharge header.

3. A method for detecting a waterlogged condition in a steam coil heating system, comprising the steps of:

providing a plurality of temperature sensors in communication with temperature data recording means, wherein each of said temperature sensors is located to measure a selected heating coil;

providing display means in communication with said temperature data recording means for displaying said temperature data for each of said plurality of temperature sensors;

determining the average temperatures for each of said plurality of temperature sensors over selected time intervals;

comparing said average temperatures to determine the difference in the average temperatures recorded by said temperature data recording means between each of said plurality of temperature sensors; and, if the average temperature of one or more of said plurality of temperature sensors closest in proximity to said discharge header remains significantly lower over a selected time interval than the average temperature of one or more of said plurality of temperature sensors more distal from said discharge header, indicating a waterlogged condition.

4. The method of claim 3, wherein said step of indicating a waterlogged condition further comprises:

if the average temperature of one or more of said plurality of temperature sensors closest in proximity to said discharge header remains at least 5° F. (9° C.) lower over a selected time interval than the average temperature of one or more of said plurality of temperature sensors more distal from said discharge header, indicating a waterlogged condition.

* * * * *